US005379466A

United States Patent [19]

Davies

[11] Patent Number: 5,379,466

[45] Date of Patent: Jan. 10, 1995

[54] PORTABLE PRIVACY CLOSET

[76] Inventor: Benjamin P. Davies, 7227 Downey Dr., Sherrodsville, Ohio 44675

[21] Appl. No.: 129,359

[22] Filed: Sep. 30, 1993

[51] Int. Cl.[6] ..... A47K 3/23; A47K 11/02

[52] U.S. Cl. ..... 4/449; 4/599

[58] Field of Search ..... 4/449, 459, 460, 476, 4/526, 528, 531, 532, 599, 602, 603; 52/67, 79.5; 135/108, 902

[56] References Cited

U.S. PATENT DOCUMENTS

| | | | |
|---|---|---|---|
| 1,095,633 | 5/1914 | Hildeton | 4/599 |
| 2,014,554 | 9/1935 | Bulthuis | 4/599 |
| 2,126,834 | 8/1938 | Steinberger | 4/608 X |
| 2,538,736 | 1/1951 | Spencer | 52/67 X |
| 2,827,004 | 3/1958 | Luce et al. | 52/67 X |
| 3,629,875 | 12/1971 | Dow | 4/599 |
| 3,657,746 | 4/1972 | Downey | 4/599 |
| 3,703,733 | 11/1972 | McLoughlin | 4/556 |
| 4,883,016 | 11/1989 | Larson | 114/363 |
| 4,974,265 | 12/1990 | Maggio | 4/449 |
| 4,975,992 | 12/1990 | Patterson et al. | 4/599 |
| 4,979,242 | 12/1990 | Maggio | 4/449 |
| 5,029,348 | 7/1991 | Boren | 4/449 |

FOREIGN PATENT DOCUMENTS

| | | | |
|---|---|---|---|
| 2173398 | 10/1986 | United Kingdom | 4/599 |

*Primary Examiner*—Robert M. Fetsuga
*Attorney, Agent, or Firm*—Michael Sand Co.

[57] ABSTRACT

A portable privacy closet which may be selectively moved from a raised to a lowered position such that when the closet is in the raised position it provides a private area for use as a changing room or for housing a toilet facility, and when in the lowered position, the closet provides a weathertight storage area. The portable privacy closet includes a base having a pair of parallel spaced apart sidewalls, a rear wall, a bottom wall and a front wall which includes a door which seals to the front wall when in the closed position. A top portion telescopically engages the base and includes a pair of parallel spaced apart sidewalls, a rear wall and a front wall formed with an access opening, selectively closed by either a curtain or a door. The top portion is selectively moved into and out of telescopic engagement with the base via a plurality of cables attached at a first end to a spool supported by the base, and attached at a second end to the top portion such that rotation of the spool causes the top portion to raise out of telescopic engagement with the base.

16 Claims, 6 Drawing Sheets

PORTABLE PRIVACY CLOSET

BACKGROUND OF THE INVENTION

1. Technical Field

The invention relates generally to portable building structures. More particularly, the invention relates to a portable enclosure for personal use which may be readily moved between raised and lowered positions. Specifically, the invention relates to a portable apparatus which when in the lowered position provides waterproof storage, and when in the raised position, provides a privacy closet for use as a changing area, or for other purposes such as providing toilet facilities.

2. Background Information

Outdoor recreation, including water recreation has flourished in the past twenty years and an increasing number of individuals are camping, hiking and boating for recreation. As a general rule, commercial or public campgrounds provide toilet, shower and changing facilities. However, an increasing number of people are camping away from public campgrounds, or are camping a significant distance from the public facilities at the campground. Further, many of the boats used for recreation on inland waterways and lakes are not large enough to provide toilet facilities or private chambers for use as a changing room out of view of other boaters, or persons on shore.

A further problem associated with camping and boating is the need for watertight storage facilities for radios and the like when the equipment is not in use.

A number of portable privacy closets have been developed to treat the above two needs separately, but none of the known privacy closets provide both storage and a private chamber. Further, while the prior art devices are presumably sufficient for the purpose for which they were intended, the prior art privacy closets include a number of other drawbacks.

While U.S. Patent No. 3,629,875 provides a portable privacy closet, it does not provide an area for storage when the closet is not in use. Moreover, it is somewhat complicated to erect as the walls must be inflated. Still further, the inflated closet is subject to rupture when in a camping or boating environment.

U.S. Pat. No. 4,883,016 provides a collapsible marine chamber. However, this chamber is not removable from the boat and also does not provide stability in a windy environment such as on a boat as all four walls are formed with a flexible curtain.

U.S. Pat. No. 2,014,554 provides a portable shower bath cabinet. However, this cabinet must be completely disassembled into respective wall and floor portions when the cabinet is to be moved or collapsed.

U.S. Pat. No. 4,979,242 is also directed to a portable room shelter that is collapsible. This structure does not provide a sealed storage area when the shelter is collapsed and moreover, the shelter utilizes a plurality of living hinge joints which are subject to cyclic stress and failure.

U.S. Pat. No. 5,029,348, is directed to a head construction for a pontoon boat. However, the shelter is relatively complicated and expensive. Moreover, the structure is not portable and therefore cannot be removed from the boat.

Therefore, a need exists for a privacy closet which is sturdy when in the raised position, and provides a sealed storage area when in the lowered position and which may be easily moved from the lowered to the raised position. Moreover, the need exists for a privacy closet which is portable and may be carried to a campsite, or onto a boat as required by the user.

SUMMARY OF THE INVENTION

Objectives of the invention include providing an improved privacy closet which is simple to move from the lowered to the raised position.

A further objective includes providing such a privacy closet which is portable and thus may be carried from a campsite to a boat as required by the user.

Another objective is to provide such a privacy closet which when in the raised position provides a private area for toilet facilities or for use as a changing area.

Yet another objective is to provide such a privacy closet which provides a sealed storage area when in the lowered position.

Yet another objective is to provide such a privacy closet which is sturdy and solid when in the raised position.

A still further objective is to provide such a portable privacy closet which is of simple construction, which achieves the stated objectives in a simple, effective and inexpensive manner, and which solves problems and satisfies needs existing in the art.

These and other objectives and advantages of the invention are obtained by the improved portable privacy closet, the general nature of which may be stated as including a base formed by a pair of rigid spaced apart sidewalls, a rear wall, a bottom wall and a front wall; a rigid door hingedly attached to said front wall; a top portion formed by a pair of rigid spaced apart sidewalls, a rigid rear wall, and a rigid top wall, and formed with a front opening, said top portion being telescopically movable with respect to the base; closure means for opening and closing the front opening in said top portion; and lift means for telescopically moving the top portion to the raised position with respect to the base.

BRIEF DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

Similar numerals refer to similar parts throughout the drawings.

DESCRIPTION OF THE PREFERRED EMBODIMENTS

Figure 1:
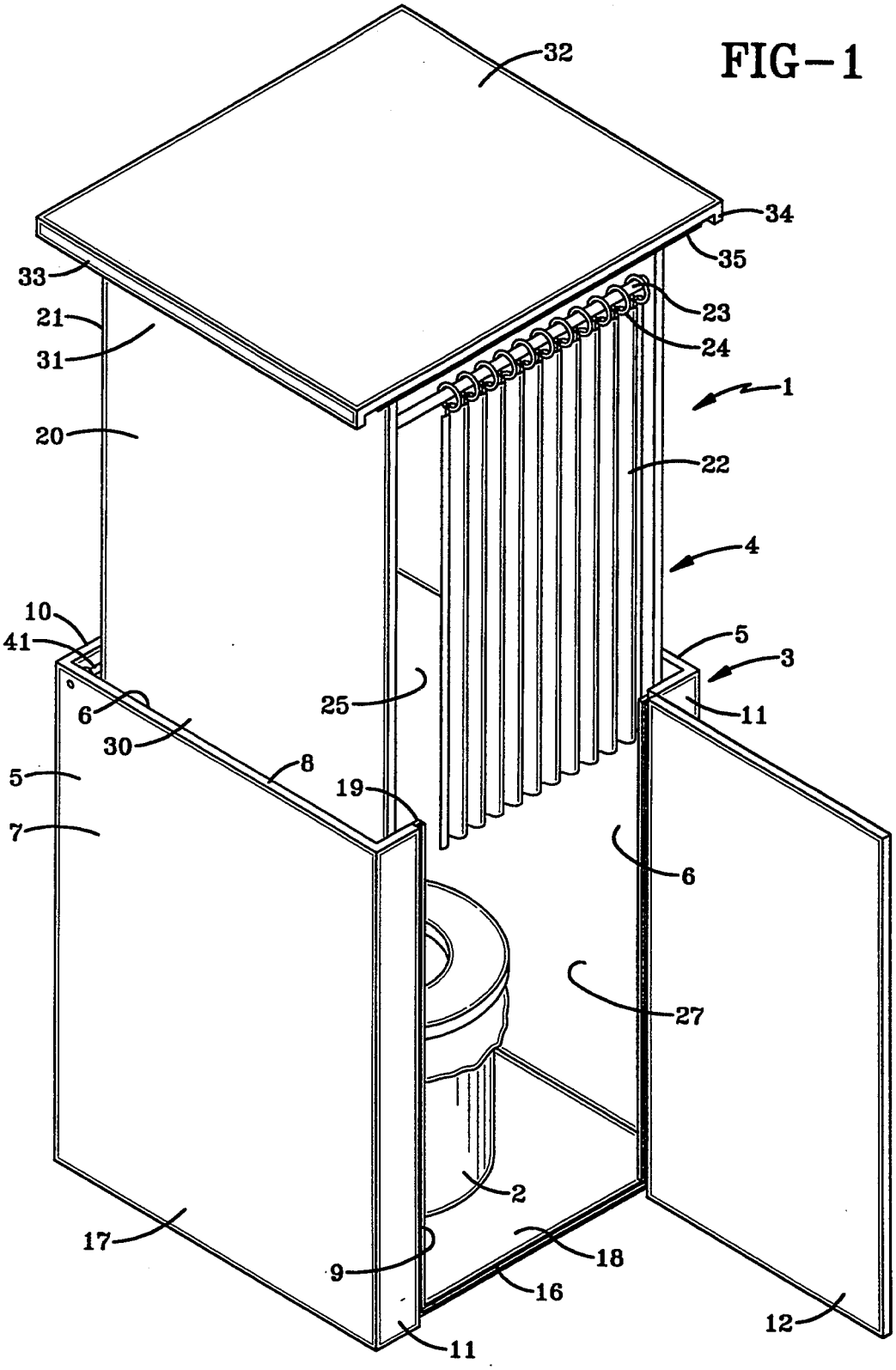
FIG. 1 is a perspective front and side view of the first embodiment of the portable privacy closet in the raised position with the door open, and shown in combination with a self contained toilet facility.

The portable privacy closet according to the present invention is designated generally at 1, and is shown particularly in FIG. 1 in cooperation with a self contained toilet 2. Toilet 2 is of known construction, and is of the type generally available, an example of which is available from Thetford Corporation, P.O. Box 1285, Ann Arbor, Mich. as model number Porta Potti 135.

Figure 2:
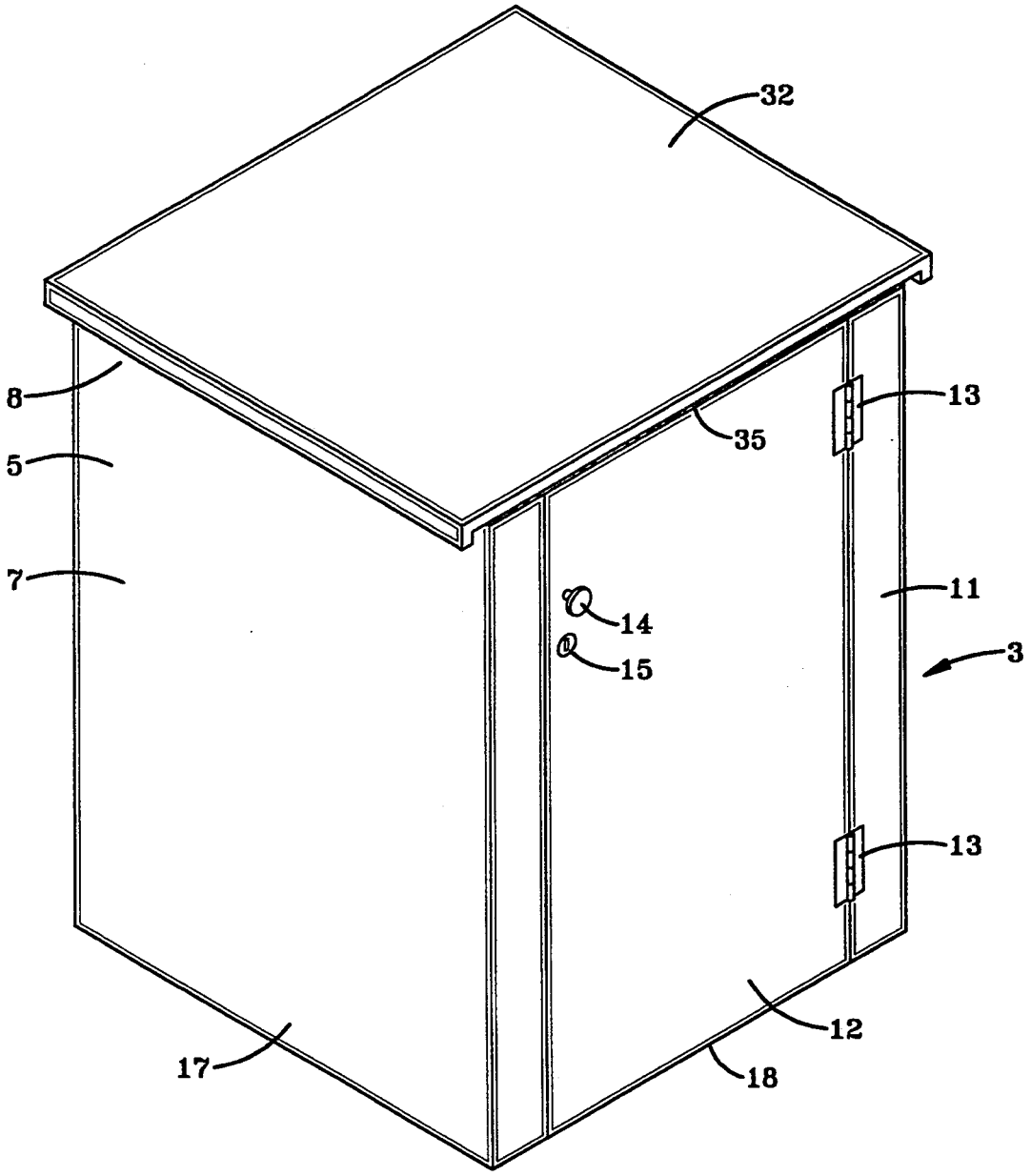
FIG. 2 is a perspective view of the portable privacy closet of FIG. 1 in the lowered position.

Closet 1 includes a base and a top portion indicated generally at 3 and 4, respectively. Base 3 includes a pair of parallel spaced apart sidewalls 5, which sidewalls each include a respective inner surface 6 and a parallel outer surface 7. Base 3 further includes a rear wall 10 and a front wall 11 which are parallel and spaced apart, and are orthogonal to sidewalls 5. Sidewalls 5, rear wall 10 and front wall 11 form a substantially square-shaped structure having a hollow interior and terminating in an upper edge 8. Front wall 11 is formed with doorway opening 9 which is open and closed by a door 12 which is pivotally mounted to front wall 11 via hinges 13 (FIG. 2). Preferably door 12 also includes a handle 14 and a lock 15 to secure door 12 in the closed position. A door stop 19 is mounted to the interior of front wall 11 which abuts door 12 when in the closed position. A weatherstrip seal 16 (FIGS. 1 and 3) extends around the inside edge of opening 9 of front wall 11, and over door stop 19 to seal the engagement between door 12 and wall 11 such that debris and rain may not enter the interior of base 3 through door 12. Sidewalls 5, rear wall 10 and front wall 11 are joined at a lower edge 17 via a bottom wall 18 (FIG. 1).

As should be apparent to one of ordinary skill in the art, any convenient locking means could be utilized without departing from the spirit of the present invention.

Top portion 4 also has a rectangular, preferably square-shaped configuration, and includes a pair of parallel spaced-apart sidewalls 20 and a rear wall 21 (FIGS. 1 and 5) normal to sidewalls 20, and has an open bottom and an open front 25, which provide a hollow interior. In a first embodiment of the invention open front 25 is closed by a flexible curtain 22 which is supported on a rod 23 via a plurality of hangers 24 and forms the front wall of top portion 4. Walls 20 and 21 include a lower edge 30 and an upper edge 31. Upper edge 31 of walls 20 and 21 are joined by a top wall 32.

In accordance with the invention, top wall 32 includes a cantilever portion 33 extending outwardly and vertically over upper edge 8 of base 3 from all four sides thereof when top portion 4 is in the lowered position of FIG. 2. The portion of cantilever 33 which extends over sidewalls 5 and rear wall 10 includes a downturned flange 34 which adds further weather resistance to closet 1. A weather seal 35 extends downwardly from the bottom surface of cantilever portion 33 such that seal 35 is interposed between top wall 32 and upper edge 8 when top portion 4 is in the lowered position as shown specifically in FIG. 2, such that the top wall 32 and edge 8 from a watertight seal therebetween.

Figure 3:
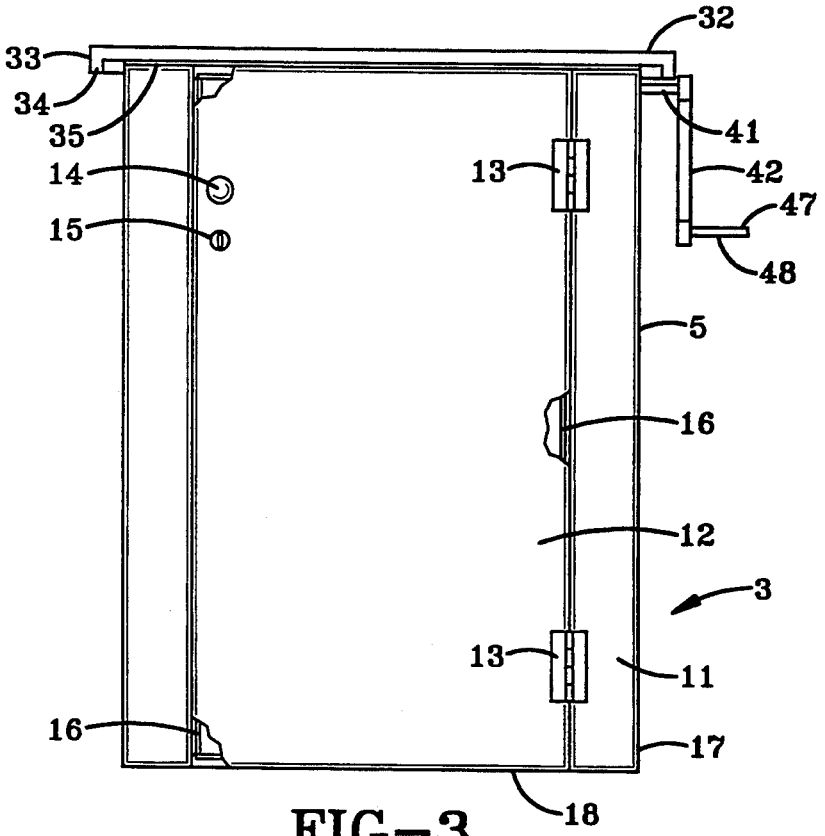
FIG. 3 is a front elevational view of the portable privacy closet of FIGS. 1 and 2 with portion broken away to reveal the door seals.
Figure 4:
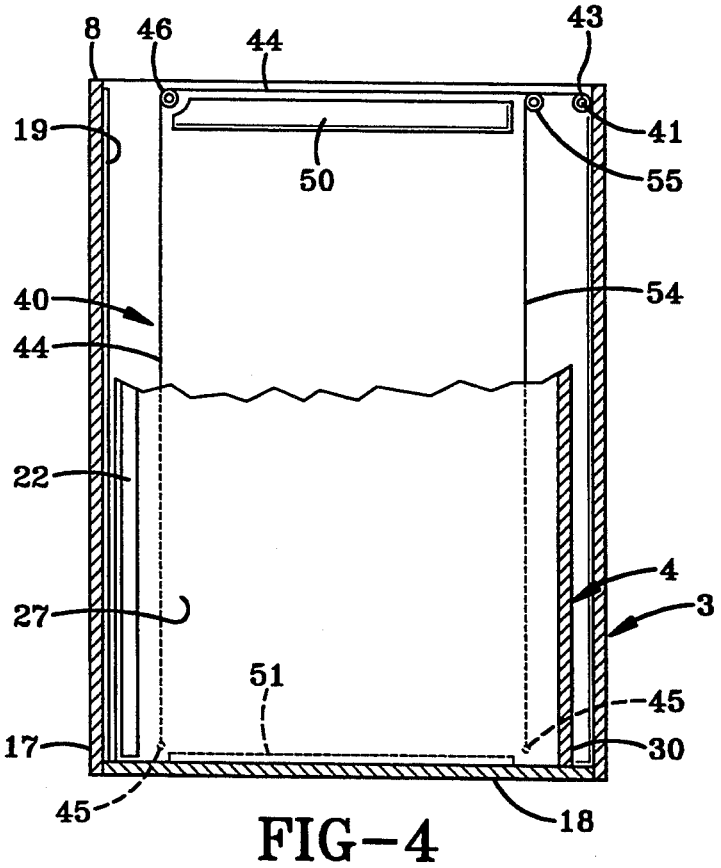
FIG. 4 is a side view of the privacy closet in the lowered position with portion shown in section, and with an upper part of the top portion broken away and in section to reveal the lifting cables.

In further accordance with another of the main features of the invention, top portion 4 is cross-sectionally smaller horizontally than base 3, such that top portion 4 may telescopically move within base 3 when in the collapsed position of FIGS. 2–4. The length or vertical height of the side and rear walls of top portion 4 are slightly less than that of base 3 so that when in the collapsed position, weather seal 35 will seal tightly against top edge 8 of base 3. When in the collapsed position the hollow interior of base 3 and top portion 4 form a storage chamber 27 which can be filled with gear and stored in a sealed environment as best seen in FIGS. 4 and 5.

Figure 5:
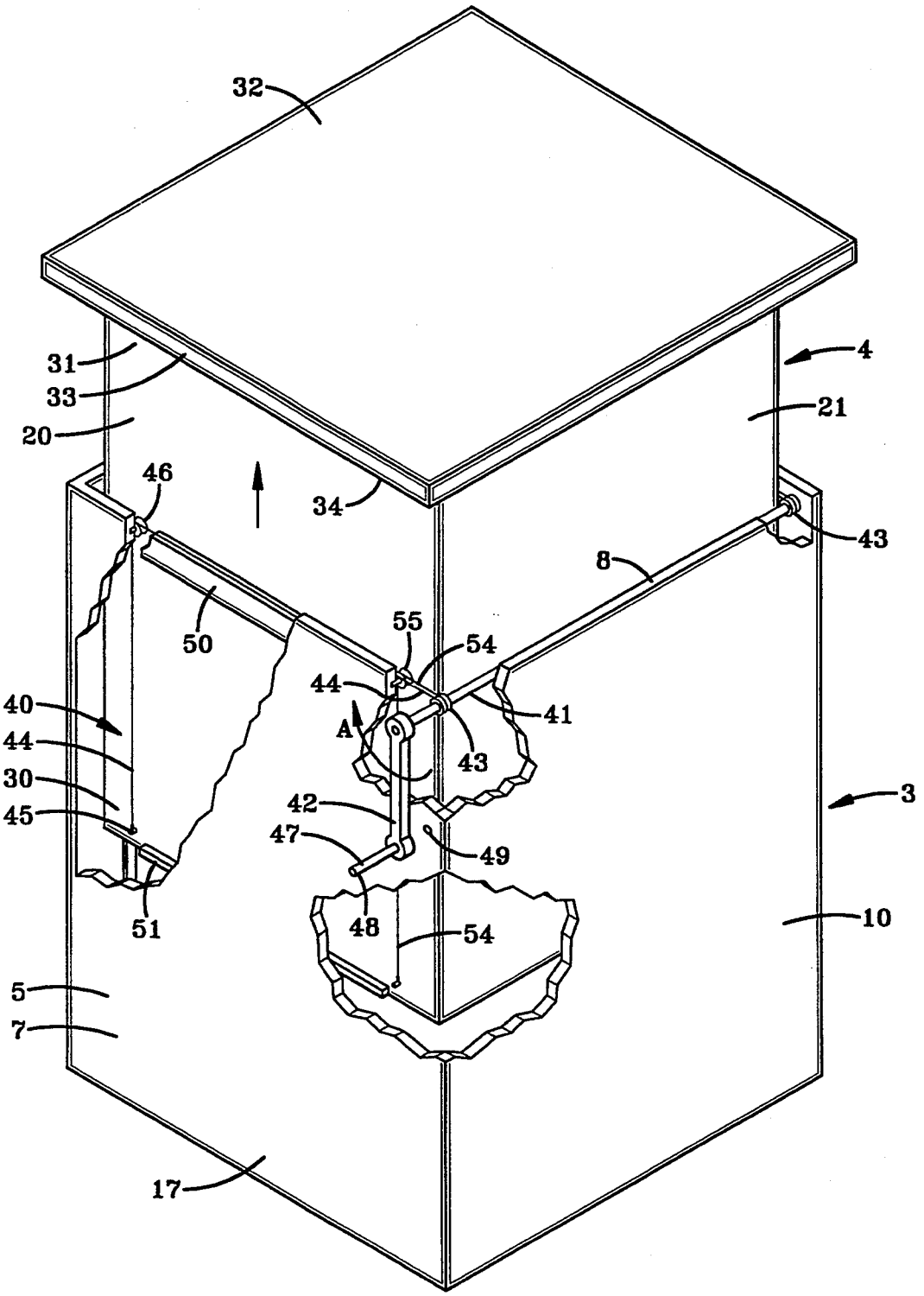
FIG. 5 is a perspective rear and side view of the portable privacy closet in the partially raised position with portions broken away.
Figure 6:
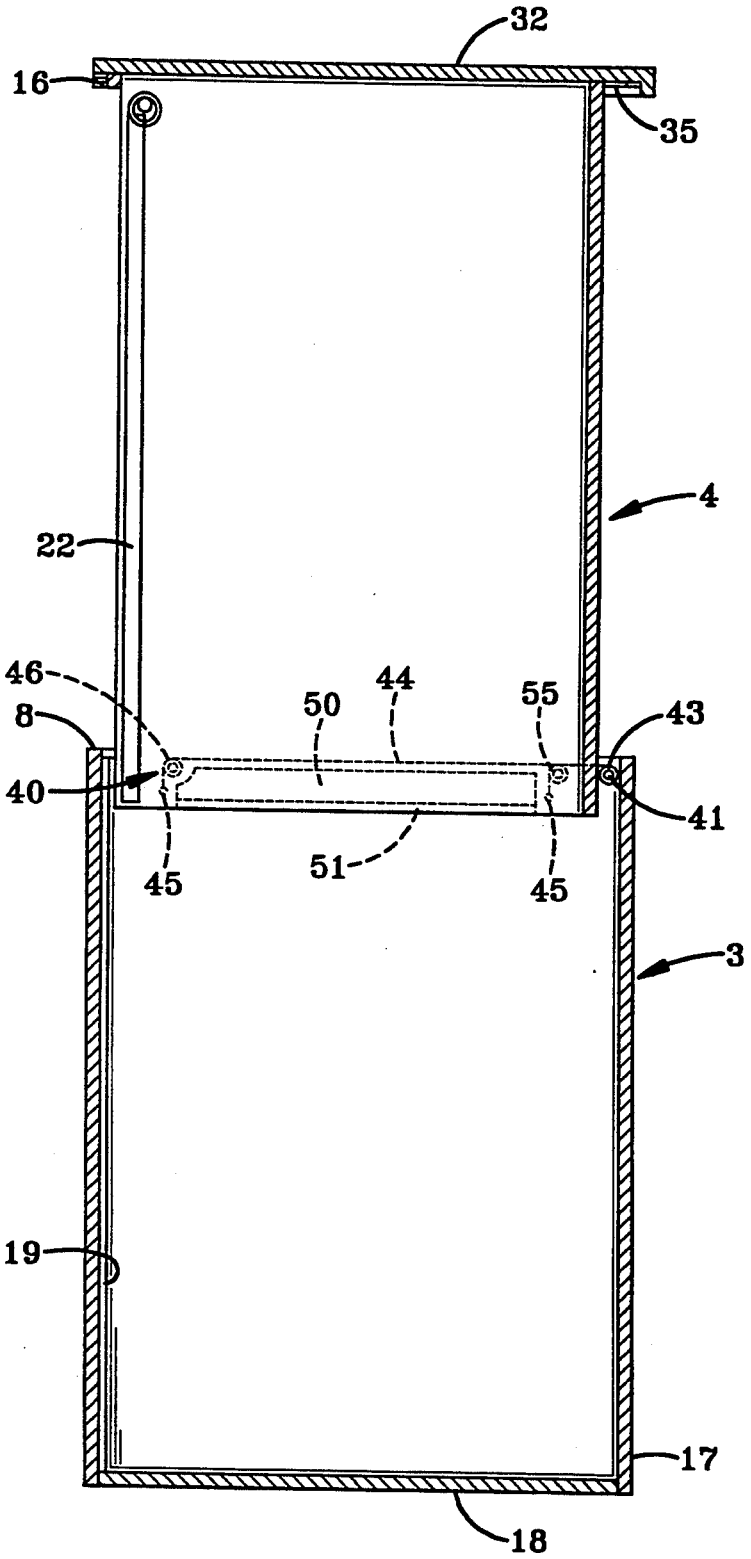
FIG. 6 is a side elevational view in section similar to FIG. 4, of the privacy closet shown in the fully raised position.

The portable privacy closet 1 also includes a lift assembly indicated generally at 40, shown in FIGS. 4–6. Lift assembly 40 includes a spool 41 which is rotatably mounted on and extends between spaced sidewalls 5, and is substantially parallel to rear wall 10 adjacent upper edge 8. In the preferred embodiment, spool 41 is a substantially cylindrical bar, but other shapes could be utilized without departing from the spirit of the present invention. Preferably each end of spool 41 extends through a respective sidewall 5 with one end having a handle 42 attached thereto. A latch 47 will lock handle 42 in position when top portion 4 is in the fully raised position of FIG. 1, or the lowered position of FIG. 2. While a variety of latches may be utilized without departing from the spirit of the present invention, the latch shown in the preferred embodiment includes a lock bar 48 (FIG. 5) which is slidably mounted within the handle, and is received in a hole 49 within one sidewall 5 sized to accept the lock bar, when top portion 4 is in the fully raised or fully lowered position.

Spool 41 includes a pair of takeup sections 43 for accepting two pairs of cables 44 and 54 when spool 41 is rotated by handle 42. In the preferred embodiment, each cable 44 has one end attached to the spool at the takeup section 43, and a second end attached to the lower edge 30 of top portion 4 via any convenient attachment device 45, such as an eyehook or screw adjacent front wall 11. Each cable 44 passes over a corresponding pulley 46 attached to an inner surface of sidewalls 5 of base 3 adjacent front wall 11, such that a substantially horizontal section of each cable 44 extends between spool 41 and a corresponding pulley 46, and a vertical section extends between lower edge 30 of top portion 4 and pulley 46. Each cable 54 is attached at one end to lower edge 30 of each sidewall 20 of top portion 4 adjacent each corner of sidewalls 20 and rear wall 21. Cables 54 extend about other pulleys 55 which are attached to sidewalls 5 of base 3 spaced forwardly from rear wall 21, with a second end of cables 54 being connected to takeup section 43. Thus both pairs of cables 44 and 55 operate in unison upon rotation of spool 41 to raise and lower top portion 4 vertically with respect to base 3.

A first cleat 50 is attached to each sidewall 5 of base 3 adjacent upper edge 8. A second cleat 51 is attached to the bottom of sidewalls 20 of top portion 4 such that first and second cleats 50 and 51 abuttingly engage when top portion 4 is in the fully raised position as shown in FIG. 6 to limit the upward vertical movement of top portion 4 and prevent separation of portion 4 and base 3.

In operation, the portable privacy closet 1 is transported in the collapsed position shown in FIG. 2 either onto a boat, or to a campsite. During transport, storage chamber 27 of base 3 may be filled with equipment which requires sealed storage, such as radios, cameras, etc. Moreover, inasmuch as closet 1 is portable, it may be used to carry equipment from an automobile to the boat or campsite. Once at the campsite, equipment may be stored therein in a sealed manner when closet 1 is not in use. When at a campsite, or on a boat, the portable privacy closet 1 may be moved to the raised position shown in FIG. 1 to provide a changing area, or for housing a usual toilet facility 2.

To move the top portion 4 from the lowered position shown in FIG. 2 to the expanded or raised position shown in FIG. 1, the lift assembly 40 is actuated when the user rotates handle 42 in the direction of arrow A (FIG. 5). Rotation of handle 42 thus effectuates rotation of spool 41. As spool 41 rotates, cables 44 and 54 are drawn over corresponding pulley 46 and 55, respectively, and are wound around spool 41 at a respective take-up section 43. The continued rotation of cables 44 and 54 thus applies an upward force to attachment device 45, and consequently to top portion 4 thereby lifting top portion 4 out of telescopic engagement with base 3. Further continued rotation of handle 42 will raise top portion 4 to the position shown in FIG. 6 where second cleat 51 is brought into abutting engagement with first cleat 50 to prevent further rotation of handle 42. When cleats 50 and 51 are in abutting engagement, lock bar 48 of latch 47 will align with hole 49. Lock bar 48 may then be slideably inserted into hole 49 to retain handle 42 in position.

Figure 7:
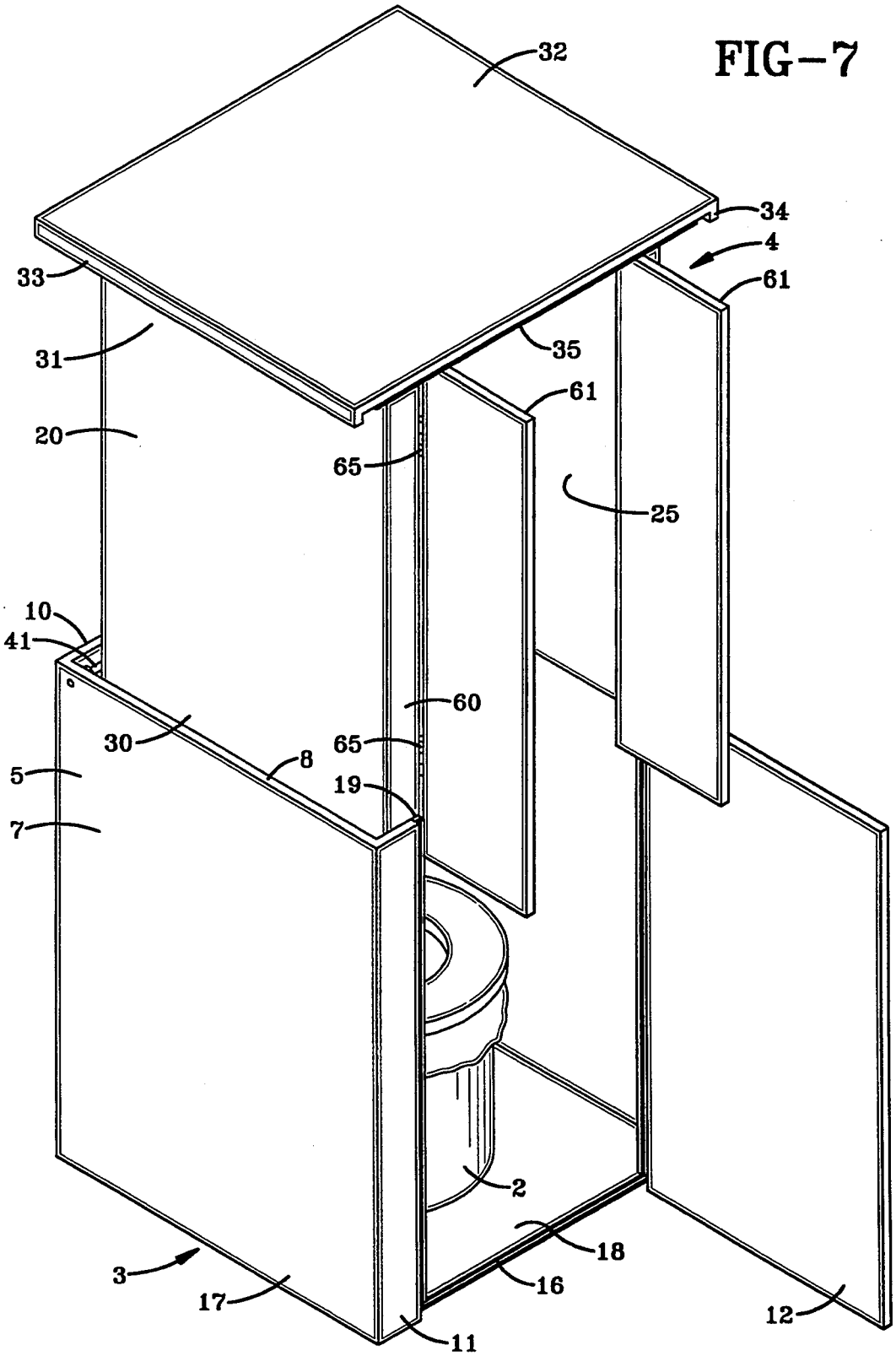
FIG. 7 is a front and side perspective view of a second embodiment of the portable privacy closet in the raised position with both doors open, and shown in combination with a self contained toilet facility.

In a second embodiment of the invention shown specifically in FIG. 7, curtain 22 is replaced with a front wall 60 and a pair of doors 61 each of which is hingedly mounted to wall 60 at hinges 65. Doors 61 are smaller than door 12 such that when doors 61 are closed they cover open front 25. Moreover, when closet 1 is in the lowered position, each door 61 will fold inwardly against an internal surface of a respective sidewall 20 to permit easy access to the equipment stored within base 3. In this manner, the second embodiment of the invention provides a substantially rigid closet when in the expanded position, and a rigid container when in the collapsed position.

In the preferred embodiment, doors 61 are manufactured of a translucent material to illuminate the interior of closet 1 when closet 1 is in the raised position. However, as should be apparent to one having ordinary skill in the art, other portions of closet 1 may be manufactured from a translucent material without departing from the spirit of the present invention.

Further, closet 1 may be provided with a watertight cavity under bottom wall 18, which cavity may be filled with water to provide added weight and stability when closet 1 is in the raised position.

Accordingly, the improved portable privacy closet is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved portable privacy is constructed and used, the characteristics of the construction, and the advantageous, new and useful results obtained; the new and useful structures, devices, elements, arrangements, parts and combinations, are set forth in the appended claims.

I claim:

1. A portable privacy closet selectively moveable between a lowered position and a raised position, said portable privacy closet comprising:

a base formed by a pair of rigid spaced apart sidewalls, a rear wall, a bottom wall and a front wall;

a rigid door hingedly attached to said front wall;

a top portion formed by a pair of rigid spaced apart sidewalls, a rigid rear wall, and a rigid top wall extending outwardly from the sidewalls of the top portion and rear wall of the top portion, and formed with a front opening, said top portion being telescopically movable with respect to the base;

closure means for opening and closing the front opening in said top portion operable between a completely open and completely closed position when the top portion is in either one of the lowered position and raised position;

lift means for telescopically moving the top portion between the raised position and the lowered position with respect to the base such that only the rigid top wall of the top portion extends out of the base when in the lowered position;

door seal means for providing sealing engagement between the door and the front wall;

outer seal means for providing sealing engagement between the top portion and the base when the portable privacy closet is in the lowered position, such outer seal means is a weather strip extending substantially around a perimeter of the rigid top wall of the base; and said top portion extending inside said base as a weathertight storage unit when the top is in the lowered position.

2. The portable privacy closet as defined in claim 1 in which the closure means includes a flexible curtain extending over said front opening.

3. The portable privacy closet as defined in claim 1 in which the top portion includes a rigid front wall; and in which the closure means includes a pair of rigid doors hingedly attached to said front wall and extending over the front opening.

4. The portable privacy closet as defined in claim 3 in which the rigid doors are manufactured from translucent plastic to permit the illumination of an interior of the portable privacy closet.

5. The portable privacy closet as defined in claim 1 in which the door seal means is a flexible weather strip.

6. The portable privacy closet as defined in claim 1 in which the lift means includes a plurality of cables attached at a first end to the top portion; and in which spool means is rotatably mounted on the base and is attached to a second end of said cables such that the rotation of the spool means in a first direction will cause the plurality of cables to wind about said spool means, and rotation of the spool means in a second direction will cause the plurality of cables to unwind from said spool means.

7. The portable privacy closet as defined in claim 6 in which the spool means includes a bar extending through the base adjacent an upper edge of said base, and a handle attached to an end of the bar.

8. The portable privacy closet as defined in claim 6 in which the lift means includes a plurality of pulleys attached to an inner surface of the pair of sidewalls of said base.

9. The portable privacy closet as defined in claim 6 in which each sidewall has a first and a second pulley attached thereto, said first pulley being attached to an inner surface of said sidewall adjacent the rear wall, and said second pulley being attached to said inner surface of said sidewall adjacent the front wall.

10. The portable privacy closet as defined in claim 9 in which each cable extends about a corresponding pulley; and in which attachment means are provided for securing a respective cable to an outer surface of the corresponding sidewall of said top portion adjacent a bottom edge thereof.

11. The portable privacy closet as defined in claim 10 in which the attachment means is located directly below a respective pulley.

12. The portable privacy closet as defined in claim 6 further comprising latch means for preventing the spool from rotating at least when the top portion is in the fully raised, or fully lowered position.

13. The portable privacy closet as defined in claim 1 in which a first cleat is attached to the base adjacent an upper edge thereof and a second cleat is attached to the top portion adjacent a bottom edge thereof; and in which said cleats contact each other when the portable privacy closet is in the raised position preventing continued upward movement of said top portion from said base.

14. The portable privacy closet as defined in claim 13 in which a first cleat is mounted on each sidewall of the base, and a second cleat is mounted on each sidewall of the top portion.

15. The portable privacy closet as defined in claim 1 in which a door stop is carried by the front wall of the base which contacts the door when in a closed position.

16. The portable,privacy closet as defined in claim 1 further comprising locking means for securing the door in a closed position.

* * * * *